US010400593B2

(12) United States Patent
Kulkarni et al.

(10) Patent No.: US 10,400,593 B2
(45) Date of Patent: Sep. 3, 2019

(54) REAL-TIME ULTRASOUND TECHNIQUES TO DETERMINE PARTICLE SIZE DISTRIBUTION

(71) Applicant: Halliburton Energy Services, Inc., Houston, TX (US)

(72) Inventors: Sandeep D. Kulkarni, Kingwood, TX (US); Cato R. McDaniel, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 14/895,962

(22) PCT Filed: Feb. 13, 2015

(86) PCT No.: PCT/US2015/015765
§ 371 (c)(1),
(2) Date: Dec. 4, 2015

(87) PCT Pub. No.: WO2016/130139
PCT Pub. Date: Aug. 18, 2016

(65) Prior Publication Data

US 2016/0369627 A1 Dec. 22, 2016

(51) Int. Cl.

| | |
|---|---|
| ***E21B 49/08*** | (2006.01) |
| ***E21B 49/00*** | (2006.01) |
| ***E21B 21/06*** | (2006.01) |
| ***E21B 21/08*** | (2006.01) |

(52) U.S. Cl.
CPC ..... *E21B 49/08* (2013.01); *E21B 21/065* (2013.01); *E21B 21/08* (2013.01); *E21B 49/005* (2013.01)

(58) Field of Classification Search
None
See application file for complete search history.

(56) References Cited

U.S. PATENT DOCUMENTS 5,741,962 A 4/1998 Birchak et al.
5,831,150 A * 11/1998 Sowerby ..... G01N 15/02 73/61.75

(Continued)

OTHER PUBLICATIONS

Krauter et al., Extinction of Radiation in Sterically Interacting Systems of Monodisperse Spheres. Part 2: Experimental Results, Part. Part. Syst. Charact 12 (1995) 132-138.

(Continued)

*Primary Examiner* — Kipp C Wallace
(74) *Attorney, Agent, or Firm* — Tenley Krueger; C. Tumey Law Group PLLC

(57) ABSTRACT

A well system including a drill string having an inlet and extending from a surface location into a wellbore and defining an annulus between the drill string and the wellbore; a fluid circuit that circulates a treatment fluid, the fluid circuit extending from the inlet, through the drill string to a bottom of the wellbore, back to the surface location within the annulus, and back to the inlet; and one or more ultrasound devices arranged at-line, off-line, or in-line with fluid circuit to monitor the treatment fluid and track a real-time particle size distribution (PSD) of one or more particles suspended within the treatment fluid.

21 Claims, 3 Drawing Sheets

(56) References Cited

U.S. PATENT DOCUMENTS

| | | | | |
|---|---|---|---|---|
| 5,969,237 | A * | 10/1999 | Jones | G01N 15/02 73/61.75 |
| 6,176,323 | B1 | 1/2001 | Weirich et al. | |
| 6,357,305 | B1 | 3/2002 | Witt et al. | |
| 6,401,538 | B1 | 6/2002 | Han et al. | |
| 6,672,163 | B2 | 1/2004 | Han et al. | |
| 7,010,979 | B2 * | 3/2006 | Scott | G01N 15/02 73/596 |
| 7,418,865 | B2 | 9/2008 | Griffiths et al. | |
| 7,587,936 | B2 | 9/2009 | Han | |
| 7,921,691 | B2 | 4/2011 | DiFoggio et al. | |
| 8,812,236 | B1 * | 8/2014 | Freeman | E21B 21/065 175/66 |
| 2002/0101373 | A1 | 8/2002 | Arndt et al. | |
| 2009/0194330 | A1 | 8/2009 | Gray | |
| 2011/0167901 | A1 * | 7/2011 | Jamison | G01N 9/00 73/152.18 |
| 2014/0166871 | A1 | 6/2014 | Jamison et al. | |
| 2015/0268374 | A1 * | 9/2015 | Rapoport | E21B 49/08 702/6 |
| 2016/0230482 | A1 * | 8/2016 | Rapoport | E21B 21/06 |

OTHER PUBLICATIONS

Saasen et al., Automatic Measurement of Drilling Fluid and Drill Cuttings Properties, 2008 IADC/SPE Drilling Conference, Orlando, FL, Mar. 4-6, 2008, IADC/SPE 112687.

Smith et al., Ultrasonic Extinction for Full Concentration, Real Time Particle Size Analysis in the Mining Industry, Automin-inG2010, 2nd International Congress on Automation in the Mining Industry, Nov. 2010, Santiago, Chile.

Khatchikian et al., Ultrasonic Particle Sizing, KONA Powder and Particle Journal, www.kona.or.jp, 1995.

Sharma et al., Ultrasonic Attenuation Spectroscopy of Industrial Slurries, Frequency Control Symposium (1997).

International Search Report and Written Opinion for PCT/US2015/015765 dated Sep. 25, 2015.

* cited by examiner

REAL-TIME ULTRASOUND TECHNIQUES TO DETERMINE PARTICLE SIZE DISTRIBUTION

BACKGROUND

The present disclosure relates to the oil and gas industry and, more particularly, to determining particle size distribution in fluids using real-time ultrasound techniques.

During the drilling and production of a subterranean formation, such as a hydrocarbon-producing well, various wellbore treatment fluids are circulated in and/or out of the well. Such fluids may include, but are not limited to, drilling fluids, drill-in fluids, completion fluids, fracturing fluids, work-over fluids, and the like. These fluids used in various subterranean formation operations, may be collectively referred as "treatment fluids" (or as "wellbore fluids"). Treatment fluids often include a plurality of particles that impart specific properties (e.g., viscosity, rheology, mud weight, and the like) and capabilities (e.g., wellbore strengthening, fluid loss control, and the like) to the treatment fluid.

Prior to being conveyed downhole, a treatment fluid may be treated by adding or removing various components to obtain a predetermined treatment fluid mixture designed for optimal efficiency of the subterranean operation being performed (e.g., drilling, fracturing, and the like). Weighting agents, for example, are often added to treatment fluid to produce a desired mud weight (i.e., density). Weighting agents are particles having a specific gravity greater than the base fluid of the treatment fluid into which they are included and, therefore, are able to affect the equivalent circulating density (ECD) of the treatment fluid. During drilling operations, the ECD is often carefully monitored and controlled relative to the fracture gradient of the subterranean formation. Typically, the ECD during drilling is close to the fracture gradient without exceeding it, and when the ECD exceeds the fracture gradient, a fracture may form in the subterranean formation and drilling fluid may be lost into the formation (often referred to as lost circulation).

Due to natural tendencies, the physical characteristics of a treatment fluid mixture may change as it is introduced downhole and traverses a wellbore in a subterranean formation, which may result in a different particle size distribution (PSD) in the treatment fluid. For example, PSD may change due to the addition of fines or cuttings entrained in a drilling fluid during a drilling operation. Moreover, particles within a treatment fluid are subject to particle size attrition resulting from breaking down or otherwise being ground to smaller sizes while in wellbore. As the particle sizes change, the PSD of the treatment fluid is correspondingly altered. In other cases, treatment fluid particles of a certain size may be lost through pores defined in the wellbore wall, and thereby also alter the PSD of the treatment fluid.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
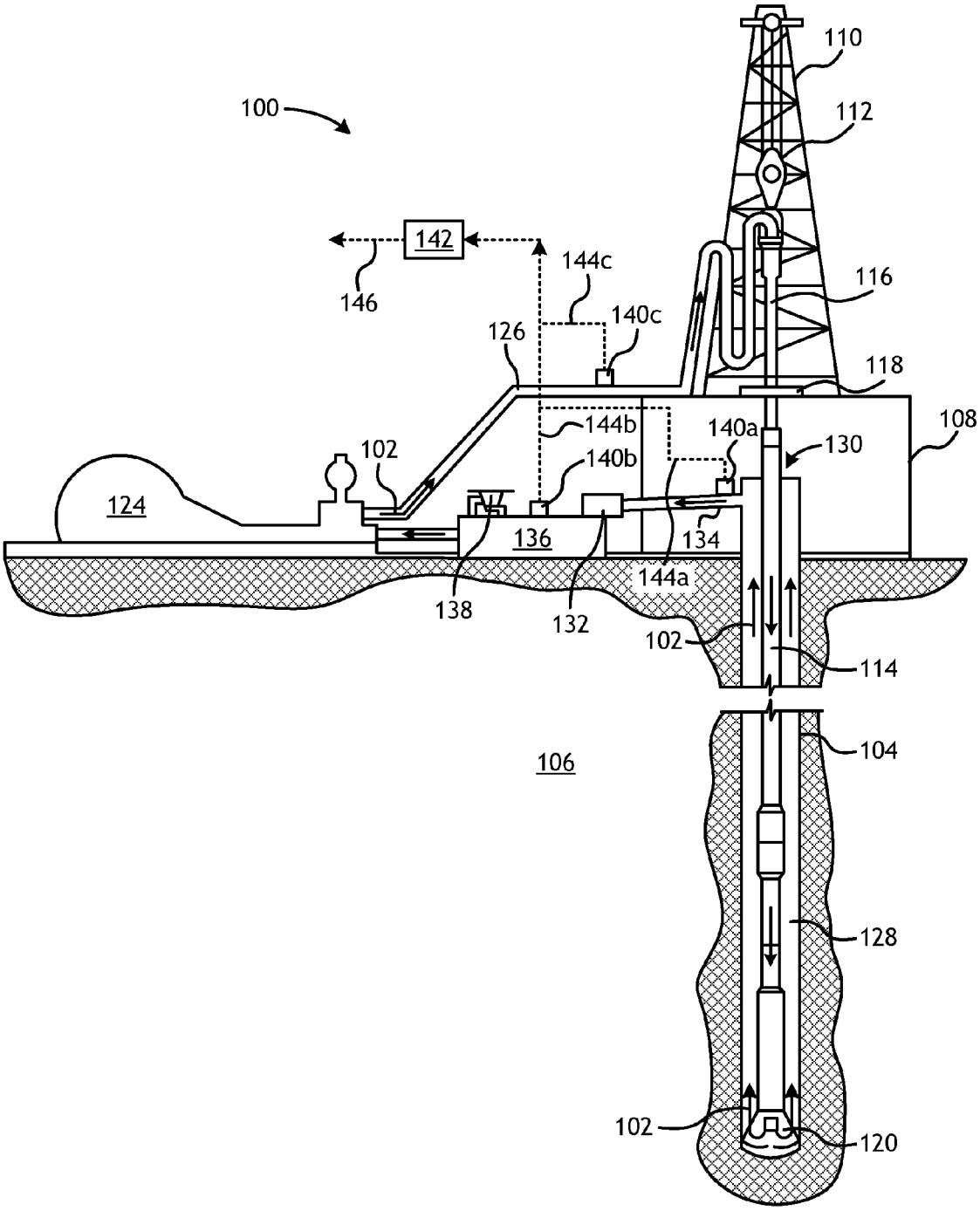
FIG. 1 is a drawing that illustrates an exemplary well system that may employ the principles of the present disclosure to monitor a treatment fluid, according to one or more embodiments.

The present disclosure relates to the oil and gas industry and, more particularly, to determining particle size distribution in fluids using real-time ultrasound techniques.

Equipment that can supply real-time measurements of PSD for wellbore treatment fluids may help well operators determine the real-time ECD of the treatment fluids. Knowing an accurate, real-time PSD of a wellbore treatment fluid may also improve control of physical conditions within a subterranean formation, such as with the addition of LCM, the identification of fines or cuttings build-up, and the like, as well as help maintain optimized particle concentrations in treatment fluids to prevent or mitigate lost circulation. Typically, PSD is measured on a sample of treatment fluid extracted from a flow line and the sample is then transported to a laboratory where the PSD is determined under laboratory conditions, which may take days and even weeks before the PSD of the treatment fluid sample is finally obtained.

Some conventional processes and/or equipment for determining PSD may employ laser diffraction methods to determine the PSD of a sample. Laser diffraction-based particle size analysis relies on the fact that particles (also referred to herein as "particulates") passing through a laser beam will scatter light at an angle that is directly related to their size. In laser diffraction, PSD may be calculated by comparing the sample's scattering pattern with an appropriate optical model by exploiting the above-described behavior of the particles that pass through the laser beam. More recently, various optical flow systems may transport a fluid within an analytical instrument to an imaging and optical analysis area.

The embodiments herein relate to ultrasound techniques to determine PSD of treatment fluids in real-time. As used herein, the term "ultrasound" refers to the sound waves having a frequency above the upper limit of human hearing, usually about 20,000 hertz. The term "ultrasound techniques," as used herein, refers to the use of ultrasonic sound waves as an analytical tool. As used herein, the term "ultrasound technique device" (or simply "ultrasound device") refers to a device that employs ultrasound techniques for obtaining the PSD of particles suspended within a treatment fluid, which may be flowing, as described herein. Determination of the PSD may include determining the number, size, and type of particles within a treatment fluid. Examples of ultrasound techniques that may be used in the embodiments of the present disclosure may include, but are not limited to, ultrasound extinction, ultrasound backscattering, ultrasound phase velocity shift, and the like, and any combination thereof. These and other ultrasound techniques may be used in the embodiments herein, without departing from the scope of the present disclosure, even though some embodiments herein are illustrated with reference to ultrasound extinction techniques.

The ultrasound techniques described herein for determining PSD may provide several advantages to the methods and systems described herein including, but not limited to, the ability to penetrate opaque media (e.g., colored media), or media with strong absorption at particular wavelengths, without hindering the ability to determine PSD therein, and any desired dilution may therefore by minimal, ultrasound frequencies are widely varied, thus allowing a wide range of detection limits, ultrasound techniques are equipmentally more stable and simple, without employing the use of multiple components that may become damaged or out of alignment, and the like.

Some embodiments herein employ at-line ultrasound technique devices that may be used on-site to determine the real-time PSD of particles suspended within various treatment fluids. The embodiments described herein may also be used off-line or in-line, without departing from the scope of the present disclosure. As used herein, the term "at-line" refers to a device (e.g., an ultrasound technique device) placed at the bypass stream of a fluid diverted from a regular fluid flow line. The term "in-line," as used herein, refers to a device (e.g., an ultrasound technique device) placed at a regular fluid flow line. As used herein, the term "off-line" refers to a device (e.g., an ultrasound technique device) placed at a stream of batch fluid that has been extracted from a regular fluid flow line, a bypass stream, or a pit (e.g., the batch fluid is circulated in a loop). In some embodiments, the ultrasound technique devices provided herein may be implemented to track the real-time PSD of LCM particles, while the treatment fluid is circulated in and out of a wellbore, such as during a drilling operation. The information obtained may be used to determine the depletion fraction and/or rate of lost circulation in the treatment fluid, such as the amount of LCM lost to the subterranean formation during circulation. Such information may also correspondingly be used to replenish that fraction of lost LCM to maintain the PSD of LCM in the treatment fluid at optimal levels. Similarly, the techniques and devices described herein may be used to track and record the real-time PSD of cuttings, weighting materials (e.g., barite), or other solids that may be present in a treatment fluid circulated through the wellbore, and thereafter used to maintain an optimal PSD of the treatment fluid. The real-time PSD information may prove advantageous in determining the effect of PSD on rheology, sag, and formation damage (if any). In addition, based on the embodiments described herein, different material libraries may be generated to identify the real-time size of an emulsion phase and its concentration in a treatment fluid. Additionally, where an emulsion phase of a treatment fluids remains stable, its contribution to the PSD may be normalized using the embodiments described herein.

Although some embodiments herein may be illustrated with reference to drilling fluids (i.e., treatment fluids used during drilling operations), it will be appreciated that any treatment fluid may be used in the embodiments described herein to employ real-time determination of PSD therein. As used herein, the term "treatment fluid" refers to a variety of fluids that may be circulated in and/or out of a subterranean formation, such as during wellbore drilling and completion operations. Accordingly, "treatment fluid" may refer to, but is not limited to, drilling fluids, drill-in fluids, completion fluids, fracturing fluids, work-over fluids, pills, spacers, sweeps, and the like. Treatment fluids may generally include water-based fluids, oil-based fluids, synthetic fluids, emulsion-based fluids, solvent-based fluids, and the like.

As used herein, the term "particles" includes all known shapes and sizes of solid materials, including substantially spherical materials, fibrous materials, polygonal materials (e.g., cubic-shaped materials), and combinations thereof. Use of the term "particles" does not imply only a single type of particle, but may rather encompass a mixture of various types of particles. As used herein, the term "particle size distribution" refers to a list of values or a mathematical function that defines the relative amount by volume of particles present within a treatment fluid according to size. In some instances, the particles described herein may have a PSD characterized by $d_{10}$, $d_{25}$, $d_{50}$, $d_{75}$, and $d_{90}$, where the term "$d_n$" (e.g., $d_{10}$, $d_{25}$, $d_{50}$, $d_{75}$, or $d_{90}$) refers to a diameter or size for which n % by volume of the particles have a smaller diameter.

Exemplary particles that may be monitored to determine PSD in a treatment fluid according to the present disclosure include, but are not limited to, weighting agents, LCMs, cuttings, neutral density particles, lightweight particles, particles added for stress cage applications, and the like, and any combination thereof. Generally, weighting agents may be defined as particles in a treatment fluid that have density higher than the base suspending liquid. In other words, the weighting agents typically have a specific gravity greater than the specific gravity of the base fluid. Examples of weighting agents may include, but are not limited to, particles that comprise barite, hematite, ilmenite, galena, manganese oxide, iron oxide, magnesium tetroxide, magnetite, siderite, celesite, dolomite, manganese carbonate, insoluble polymeric materials, calcium carbonate, marble, polyethylene, polypropylene, graphitic materials, silica, limestone, dolomite, a salt (e.g., salt crystals), shale, bentonite, kaolinite, sepiolite, illite, hectorite, organo-clays, and the like, and any combination thereof.

In some embodiments, LCMs may comprise particles having a low aspect ratio (e.g., less than about 3), fibrous particles, or both. Suitable LCMs may include, but are not limited to, sand, shale, ground marble, bauxite, ceramic materials, glass materials, metal pellets, high strength synthetic fibers, resilient graphitic carbon, cellulose flakes, wood, resins, polymer materials (cross-linked or otherwise), polytetrafluoroethylene materials, nut shell pieces, cured resinous particles comprising nut shell pieces, seed shell pieces, cured resinous particles comprising seed shell pieces, fruit pit pieces, cured resinous particles comprising fruit pit pieces, composite materials, and any combination thereof. Suitable composite materials may comprise a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and the like, and any combination thereof.

Examples of suitable LCMs that are fibrous particles may include, but are not limited to, fibers of cellulose (e.g., viscose cellulosic fibers, oil coated cellulosic fibers, fibers derived from a plant product like paper fibers, and the like); carbon fibers; melt-processed inorganic fibers (e.g., basalt fibers, woolastonite fibers, non-amorphous metallic fibers, metal oxide fibers, mixed metal oxide fibers, ceramic fibers, glass fibers, and the like); polymeric fibers (e.g., polypropylene fibers, poly(acrylic nitrile) fibers, and the like); metal oxide fibers; mixed metal oxide fibers; protein-based fibers (e.g., soy protein fiber, milk protein fiber, and the like); PAN fibers (i.e., carbon fibers derived from poly(acrylonitrile); poly(lactide) fibers; alumina fibers; and the like; and any combination thereof. Additional examples of suitable commercially available LCM fibers may include, but are not limited to, PANEX® fibers (carbon fibers, available from Zoltek) including PANEX® 32, PANEX® 35-0.125", and PANEX® 35-0.25"; PANOX® fibers (oxidized PAN fibers, available from SGL Group); rayon fibers including BDF™ 456 (rayon fibers, available from Halliburton Energy Services, Inc.); BAROFIBRE® fibers including BAROFIBRE® and BAROFIBRE® C (cellulosic fibers, available from Halliburton Energy Services, Inc.); and any combination thereof.

In some embodiments, LCM particles and/or fibers may comprise a degradable material. Non-limiting examples of suitable degradable materials that may be used in the present disclosure include, but are not limited to, degradable polymers (cross-linked or otherwise), dehydrated compounds, and/or mixtures of the two. In choosing the appropriate degradable material, one should consider the degradation products that will result. As used herein, the term "degradable" and all of its grammatical variants (e.g., "degrade," "degradation," "degrading," and the like) refers to the dissolution or chemical conversion of materials into smaller components, intermediates, or end products by at least one of solubilization, hydrolytic degradation, biologically formed entities (e.g., bacteria or enzymes), chemical reactions, electrochemical processes, thermal reactions, or reactions induced by radiation. Polymers may be homopolymers, random, linear, crosslinked, block, graft, and star- and hyper-branched. Such suitable polymers may be prepared by polycondensation reactions, ring-opening polymerizations, free radical polymerizations, anionic polymerizations, carbocationic polymerizations, coordinative ring-opening polymerization, and any other suitable process. Specific examples of suitable polymers include polysaccharides such as dextran or cellulose; chitin; chitosan; proteins; orthoesters; aliphatic polyesters; poly(lactide); poly(glycolide); poly(ε-caprolactone); poly(hydroxybutyrate); poly(anhydrides); aliphatic polycarbonates; poly(orthoethers); poly (amino acids); poly(ethylene oxide); polyphosphazenes; and any combination thereof. Of these suitable polymers, aliphatic polyesters and polyanhydrides are preferred.

Dehydrated compounds may be used in accordance with the present invention as a degradable solid particle. A dehydrated compound is suitable for use in the present disclosure if it will degrade over time as it is rehydrated. For example, particle solid anhydrous borate material that degrades over time may be suitable. Specific examples of particle solid anhydrous borate materials that may be used include, but are not limited to, anhydrous sodium tetraborate (also known as anhydrous borax), anhydrous boric acid, and the like.

Degradable materials may also be combined or blended. One example of a suitable blend of materials is a mixture of poly(lactic acid) and sodium borate where the mixing of an acid and base could result in a neutral solution where this is desirable. Another example would include a blend of poly (lactic acid) and boric oxide, a blend of calcium carbonate and poly(lactic) acid, a blend of magnesium oxide and poly(lactic) acid, and the like, and any combination thereof. In certain preferred embodiments, the degradable material is calcium carbonate plus poly(lactic) acid. Where a mixture including poly(lactic) acid is used, in certain preferred embodiments the poly(lactic) acid is present in the mixture in a stoichiometric amount (e.g., where a mixture of calcium carbonate and poly(lactic) acid is used, the mixture comprises two poly(lactic) acid units for each calcium carbonate unit). Other blends that undergo an irreversible degradation may also be suitable, if the products of the degradation do not undesirably interfere either with the subterranean formation operations.

Some particles might be designed to change shape with a predetermined or proper environmental trigger, or over a lapse of time. For example, a fiber may be configured to coil or uncoil depending on a temperature or concentration of one or more components included in a treatment fluid. The embodiments of the present disclosure may prove advantageous in monitoring the state of such particles.

Neutral density particles are particles that exhibit a density that is close to that of a base suspending liquid. Examples of neutral density particles may include, but are not limited to, polystyrene particles, polyethylenes, polypropylenes, polybutylenes, polyamides, polystyrenes, polyacronitriles, polyvinyl acetates, styrene-butadienes, polymethylpentenes, ethylene-propylenes, natural rubbers, butyl rubbers, polycarbonates, buckyballs, carbon nanotubes, nanoclays, exfoliated graphites, and the like, and any combination thereof. Lightweight particles are particles that exhibit a density that is less than that of a base suspending liquid. One example of a lightweight particle is hollow glass particles (e.g., bubbles). Particles added for stress cage applications may be similar to the examples provided above for the weighting agents.

Referring now to FIG. 1, illustrated is an exemplary well system 100 that may employ the principles of the present disclosure in monitoring a treatment fluid 102, according to one or more embodiments. As illustrated, the well system 100 may be a drilling facility or rig used to drill a wellbore 104 through various subterranean formations 106. Accordingly, in at least one embodiment, the treatment fluid 102 may be a type of treatment fluid circulated into the wellbore 104, such as a drilling fluid that enables drilling operations. In other embodiments, however, the treatment fluid 102 may be any of the treatment fluids mentioned herein, without departing from the scope of the disclosure.

In the illustrated embodiment, the well system 100 may include a drilling platform 108 that supports a derrick 110 having a traveling block 112 for raising and lowering a drill string 114. A kelly 116 supports the drill string 114 as it is lowered through a rotary table 118. As will be appreciated by those skilled in the art, a top drive may alternatively be used in place of the kelly 116 and the rotary table 118. A drill bit 120 is attached to the distal end of the drill string 114 and is driven either by a downhole motor and/or via rotation of the drill string 114 from the well surface. As the bit 120 rotates, it creates the wellbore 104 that penetrates subterranean formation 106.

A pump 124 (e.g., a mud pump) circulates the treatment fluid 102 through a feed pipe 126 and to the kelly 116, which conveys the treatment fluid 102 downhole through an interior conduit defined in the drill string 114 and eventually through one or more orifices in the drill bit 120. The treatment fluid 102 is then circulated back to the surface via an annulus 128 defined between the drill string 114 and the walls of the wellbore 104 (or casing). During drilling operations, the treatment fluid 102 (i.e., drilling fluid in this case) serves several purposes, such as providing hydrostatic pressure to prevent formation fluids from entering into the wellbore 104, keeping the drill bit 120 cool and clean during drilling, and the like. The treatment fluid 102 also serves to carry drill cuttings and solids/particles (e.g., wellbore fines) out of the wellbore 104 and suspend the drill cuttings and solids/particles while drilling is paused and/or when the drill bit 120 is moved in and out of the wellbore 104.

As the spent treatment fluid 102 returns to the surface, it may exit the annulus 128 at a wellhead 130 and may be conveyed to one or more solids control equipment 132 via an interconnecting flow line 134. The solids control equipment 132 may include several fluid rehabilitation devices such as, but not limited to, a shaker (e.g., shale shaker), a sieve, a centrifuge, a hydrocyclone, a separator, a desilter, a desander, a separator operating with magnetic fields or electric fields, combinations thereof, and the like. The solids control equipment 132 may be configured to substantially remove drill cuttings and other solid particles from the treatment fluid 102 and deposit a cleaned treatment fluid 102 into a nearby retention pit 136 (e.g., a mud pit). The flow path that the treatment fluid 102 takes to circulate through the wellbore 104 and back to the surface may be characterized and otherwise referred to herein as the "fluid circuit" of the well system 100.

In applications where the treatment fluid 102 is a drilling fluid, several additives or components may be added to the treatment fluid 102 to maintain the treatment fluid 102 in proper working order and otherwise enhance drilling capabilities. In some embodiments, the additives and components may be added to the treatment fluid 102 via a mixing hopper 138 fluidly coupled to the retention pit 136. The rehabilitated treatment fluid 102 may then be recirculated and pumped back into the wellbore 104 with the pump 124 via the feed pipe 126.

While circulating through the fluid circuit, the various fluid additives and components suspended within the treatment fluid 102 may gradually be depleted or otherwise inadvertently removed in the solids control equipment 132. The depletion rate of such additives and components may be counteracted with proper fluid treatment or management of the treatment fluid 102. Knowing the proper and correct treatment rate in real-time and on-site at the well system 100 may prove useful in optimizing the effectiveness of the treatment fluid 102.

According to the present disclosure, one or more ultrasound devices 140 (shown as ultrasound devices 140*a*, 140*b*, and 140*c*) may be included at various points throughout the well system 100 to monitor the treatment fluid 102 and track the real-time PSD of various particles present within the treatment fluid 102. As described in greater detail below, each ultrasound device 140*a-c* may comprise at least an ultrasound emitter and an ultrasound receiver capable of determining particle concentration, size, and shape. The devices 140*a-c* may further be configured to measure and report the real-time PSD of particles suspended within the treatment fluid 102, which may provide an operator with data useful in adjusting various drilling parameters to optimize drilling operations in real-time. That is, the embodiments herein employing the devices 140*a-c* may be used to manage PSD and control ECD in the field.

Each ultrasound device 140*a-c* may be fluidly arranged in the fluid circuit of the well system 100 such that each is in fluid communication with the treatment fluid 102. In some embodiments, for instance, one or more of the ultrasound devices 140*a-c* may be in direct fluid communication with the treatment fluid 102 as it circulates through the fluid circuit. In other embodiments, however, one or more of the ultrasound devices 140*a-c* may fluidly communicate with a conduit or other flow line (not shown) that extends from the fluid circuit to provide an extracted fluid sample of the treatment fluid 102 to the ultrasound device 140*a-c*. Accordingly, one or more of the ultrasound devices 140*a-c* may be arranged at-line, off-line, in-line, or any combination thereof relative to the fluid circuit to monitor the treatment fluid 102, without departing from the scope of the present disclosure. Although described in terms of multiple ultrasound devices below, it will be appreciated that a single ultrasound device may provide PSD measurements at various points in the lifetime of the treatment fluid 102 (e.g., as it enters a wellbore and as it exits the wellbore) for direct comparison, without departing from the scope of the present disclosure.

In some embodiments, as illustrated, a first ultrasound device 140*a* may be fluidly arranged in the well system 100 to monitor the treatment fluid 102 as it returns to the surface and otherwise exits out of the wellbore 104 following circulation. More particularly, the first ultrasound device 140*a* may be fluidly arranged to monitor the treatment fluid 102 within the flow line 134, the wellhead 130, and/or the annulus 128 near the wellhead 130, and thereby be able to monitor the returning treatment fluid 102. If an initial PSD of the treatment fluid 102 were known prior to conveying the treatment fluid 102 into the wellbore 104, the first ultrasound device 140*a* may prove useful in providing real-time, on-site data indicative of how the PSD of the treatment fluid 102 changed after circulating through the wellbore 104.

In some embodiments, a second ultrasound device 140*b* may be fluidly arranged at or near the retention pit 136, and otherwise following the solids control equipment 132. The second ultrasound device 140*b* may be configured to monitor the treatment fluid 102 after it has undergone one or more treatments in the solids control equipment 132, thereby providing a real-time PSD of the treatment fluid 102 after it has been cleaned. In some embodiments, the second ultrasound device 140*b* may also be configured to monitor the treatment fluid 102 in the retention pit 136 as supplementary additive components or particles are added or otherwise mixed into the treatment fluid 102 via the mixing hopper 138. For instance, the second ultrasound device 140*b* may be able to report to an operator when a predetermined PSD of a particular additive component or particle (e.g., a weighting agent, LCM, or the like) has been added to the treatment fluid 102 such that the performance of the treatment fluid 102 is optimized. As will be appreciated, such real-time PSD measurements avoid unnecessarily over-treating the treatment fluid 102, and thereby saves time and costs.

In some embodiments, a third ultrasound device 140*c* may be fluidly arranged in the fluid circuit following the retention pit 136, but prior to being reintroduced downhole. For instance, as illustrated, the third ultrasound device 140*c* may be fluidly arranged at some point along the feed pipe 126 that feeds the treatment fluid 102 into the drill string 114. In other embodiments, the third ultrasound device 140*c* may be fluidly arranged between the retention pit 136 and the mud pump 124. The third ultrasound device 140*c* may be useful in detecting the PSD of the treatment fluid 102 following the retention pit 136, and thereby confirming whether adequate amounts or concentrations of particles have been added to the treatment fluid 102 to ensure optimal or predetermined levels for adequate operation. In other embodiments, the third ultrasound device 140*c* may be useful in providing an initial PSD reading of the treatment fluid 102 prior to the treatment fluid 102 being conveyed into the wellbore 104. Such an initial PSD reading may be compared with the data derived from the first ultrasound device 140*a* to determine how the PSD of the treatment fluid 102 changed following circulation through the wellbore 104.

One or all of the ultrasound devices 140*a-c* may be communicably coupled to a signal processor 142 and configured to convey corresponding output signals 144*a-c* thereto. The signal processor 142 may be a computer including a processor and a machine-readable storage medium having instructions stored thereon, which, when executed by the processor, cause the signal processor 142 to perform a number of operations, such as determining the PSD of the treatment fluid 102 at locations in the fluid circuit where each ultrasound device 140*a-c* is situated. Moreover, the signal processor 142 may employ one or more algorithms configured to calculate or otherwise determine any differences between any two or more of the output signals 144*a-c*. Accordingly, in at least one embodiment, the signal processor 142 may be configured to determine how the PSD of the treatment fluid 102 changes between each monitoring location.

In real-time or near real-time, the signal processor 142 may be configured to provide a resulting output signal 146 corresponding to the PSD of the treatment fluid 102 at any one of the monitoring locations. In other embodiments, the resulting output signal 146 may provide a measured difference in the PSD between any of the monitoring locations. The resulting output signal 146 may be conveyed, either wired or wirelessly, to a well operator for consideration.

Figure 2:
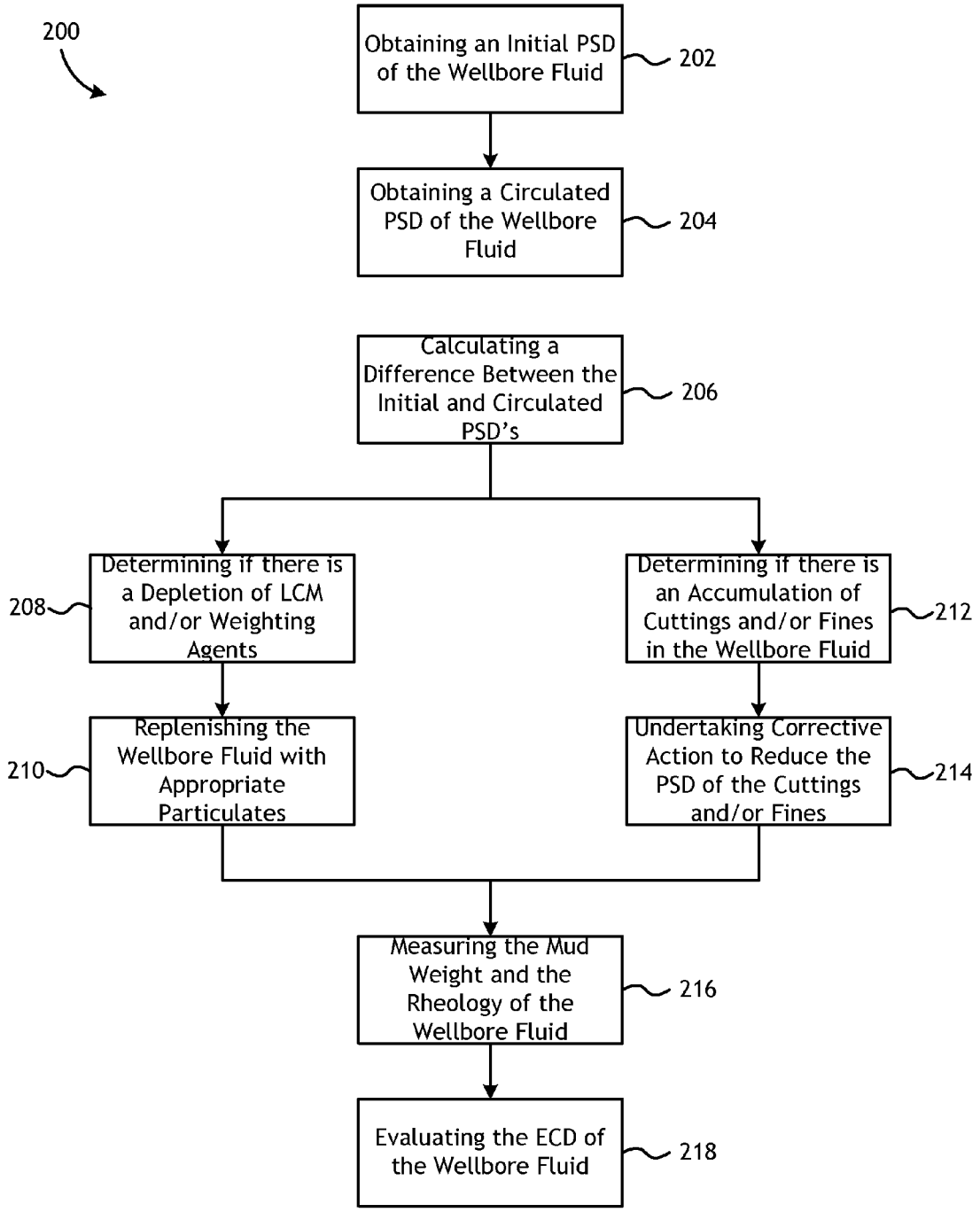
FIG. 2 is a schematic flowchart depicting a method for measuring real-time PSD of a treatment fluid, according to one or more embodiments.

Referring now to FIG. 2, with continued reference to FIG. 1, illustrated is a schematic flowchart of a method 200 for on-site measurement of real-time PSD of a treatment fluid, according to one or more embodiments described herein. The method 200 may be implemented in the well system 100 of FIG. 1 and, therefore, the treatment fluid to be monitored may be the treatment fluid 102 or drilling fluid that is circulated into the wellbore 104. In some embodiments, however, the method 200 may be implemented in a similar well system that circulates a different type of treatment fluid through a fluid circuit and equally obtains on-site, real-time PSD measurements, without departing from the scope of the disclosure.

According to the method, with reference to the well system 100 of FIG. 1 for description purposes, an initial PSD of the treatment fluid 102 may be obtained on-site in real-time prior to introducing the treatment fluid 12 downhole, as at 202. The initial PSD of the treatment fluid 102 may be obtained by using one or more ultrasound devices 140*a-c*, such as the third ultrasound device 140*c*. The particles that may be present or otherwise suspended within the treatment fluid 102 may include, for example, weighting agents, LCM, fines and/or cuttings, neutral density particles, lightweight particles, particles added for stress cage applications, and the like, and any combination thereof. Following circulation of the treatment fluid 102 in and out of the wellbore 104, a circulated PSD of the treatment fluid 102 may be obtained on-site and in real-time as the treatment fluid 102 exits the wellbore 104, as at 204. The circulated PSD of the treatment fluid 102 may be obtained, for example, by using the first ultrasound device 140*a*. In at least one embodiment, the circulated PSD of the treatment fluid 102 may be obtained prior to rehabilitating the treatment fluid 102 in the solids control equipment 132. In other embodiments, however, the circulated PSD of the treatment fluid 102 may be obtained after the treatment fluid has been processed in the solids control equipment 132, without departing from the scope of the disclosure.

The ultrasound devices 140*a-c* may each convey corresponding output signals 144*a-c* to the signal processor 142, where each output signal 144*a-c* is indicative of the PSD of the treatment fluid 102 at the particular location in the fluid circuit where each ultrasound device 140*a-c* is situated. The difference between the initial and circulated PSD of the treatment fluid 102 may then be obtained using the signal processor 142, as at 206. The signal processor 142 may then generate the resulting output signal 146 and convey the same (wired or wirelessly) to a well operator for consideration. In some embodiments, for instance, the resulting output signal 146 may be graphically displayed on a user interface, such as a computer monitor, a hand-held device, or a paper printout. In other embodiments, the resulting output signal 146 may trigger an alarm (audible or visual) configured to alert the operator to an abnormal PSD detection or reading. The resulting output signal 146 may inform an operator as to whether there is a depletion of LCM or weighting agent in the treatment fluid 102, and/or whether there is an accumulation of fines in the treatment fluid 102.

If the resulting output signal 146 indicates that a predetermined or preprogrammed range of suitable operation has been surpassed for the treatment fluid 102, the operator may be notified and thereafter proceed to undertake appropriate corrective action to bring the resulting output signal 146 back to a more reasonable or suitable value. In some embodiments, however, the signal processor 142 may be configured to act autonomously when the resulting output signal 146 is within or without the predetermined or preprogrammed range of suitable operation for the treatment fluid 10. In such embodiments, the signal processor 142 may autonomously undertake the appropriate corrective action such that the resulting output signal 146 returns to a value within the predetermined or preprogrammed range of suitable operation.

In some embodiments, the resulting output signal 146 may report a depletion of LCM and/or weighting agents in the treatment fluid 102, as at 208. In such embodiments, one corrective action that may be undertaken to bring the treatment fluid 102 back into a preprogrammed range of suitable operation may include replenishing the treatment fluid 102 with appropriate particulates (e.g., weighting agents or LCM), as at 210. This may be done, for instance, using the mixing hopper 138, and may be subsequently verified by once again consulting the resulting output signal 146.

In other embodiments, the resulting output signal 146 may report an accumulation of cuttings and/or fines in the treatment fluid 102, as at 212. In such embodiments, one or more corrective actions may be undertaken to reduce the PSD of cuttings and/or fines in the treatment fluid 102 and thereby bring the treatment fluid 102 back into a preprogrammed range of suitable operation, as at 214. Some corrective actions that may be undertaken to reduce the PSD of cuttings and/or fines in the treatment fluid 102 include diluting the treatment fluid 102 with a base oil and/or adding shale/clay stabilizers to the treatment fluid 102 to avoid further erosion of shales. Another corrective action that may be undertaken upon being alerted to an accumulation of cuttings and fines in the treatment fluid 102 may include re-processing the treatment fluid 102 within the solids control equipment 132, or by employing more than one solids control equipment 132.

One common problem encountered with some solids control equipment 132 is the inefficient removal of wellbore fines and cuttings. For example, when solids control equipment 132 are not properly tuned, they can sometimes pass unwanted solids or other contaminating particles into the retention pit 136, thereby having an adverse effect on PSD and degrading the treatment fluid 102 recirculated back into the wellbore 104. To help avoid this problem, the first and second ultrasound devices 140*a,b* may be configured to monitor the inlet and outlet of the solids control equipment 132, respectively, and thereby provide an operator with a real-time indication of the efficiency of the solids control equipment 132. In other embodiments, as will be appreciated, only the outlet of the solids control equipment 132 may be monitored and tracked over time to determine how the PSD changes over time. The output signals 144*a,b* derived from each ultrasound device 140*a,b*, respectively, may provide the operator with valuable data regarding the PSD of cuttings and/or fines within the treatment fluid 102 before and after the solids control equipment 132. As such, consulting the first and second output signals 144*a,b* may serve as a quality control measure for the treatment fluid 102. When concentrations of cuttings and/or fines are elevated, the operator may decide to re-process the treatment fluid 102 through the solids control equipment 132 or otherwise alter the parameters thereof in response. As described in more detail below, another option is to add a diluent (e.g., base oil) to bring fine cuttings concentration to within an acceptable range.

In other cases, un-tuned solids control equipment 132 may inadvertently remove valuable additive components or particles, such as weighting agents or LCM, from the treatment fluid 102, likewise having an adverse effect on PSD and the performance of the treatment fluid 102. Accordingly, tuning the solids control equipment 132 may help pass a certain percentage of weighting agents and/or LCM to be recirculated back into the wellbore 104. By comparing the first and second output signals 144*a,b* (or monitoring only the second output signal 144*b* over time), an operator may determine whether the solids control equipment 132 is removing the weighting agents and/or LCM from the treatment fluid 102, or whether the solids control equipment 132 is allowing an appropriate amount to pass into the retention pit 136 along with the cleaned treatment fluid 102. In order to achieve optimal operation, one or more parameters of the solids control equipment 132 may be adjusted, such as changing out screens or feedrates. This may also prove advantageous in providing an estimate as to how much weighting agents and/or LCM may need to be put back into the treatment fluid 102 via, for example, the mixing hopper 138.

Once the PSD of the treatment fluid 102 has been detected, reported, and corrective actions have been undertaken to treat the treatment fluid 102 and thereby optimize its performance, the mud weight (MW) and the rheology of the treated treatment fluid 102 may be obtained, as at 216. The mud weight and the rheology of the treatment fluid 102 may be measured with various known tools and devices, such as the Real Time Density and Viscosity (RTDV) Measurement Unit available from Halliburton Energy Services of Houston, Tex. The RTDV is able to measure the density rheology and viscosity of treatment fluids (e.g., drilling fluids), and may be used on-site at the well system 100 to monitor the treatment fluid 102. The other fluid properties that can be measured for treatment fluid 102 may include the oil-to-water ratio, average specific gravity, salt content, etc.

The method 200 may then include evaluating the equivalent circulating density (ECD) of the treatment fluid 102, as at 218. More particularly, the ECD of a selected LCM and carrier fluid combination may be calculated to ensure that the ECD is in an acceptable operating range. Software may be used to determine the ECD based on the mud weight and rheology of the treatment fluid 102. It will be appreciated, however, that ECD may also depend on various operational parameters (e.g., flow rates) and wellbore geometry (e.g., drill string configuration). More specifically, the ECD at a point in the wellbore annulus 128 is the effective fluid density experienced at that point that comprises a contribution from the intrinsic density of a fluid (i.e., the treatment fluid 102) and a contribution from flow-induced pressure drop in the annulus 128 above the point in the wellbore 104. The ECD at a given point in the annulus may be determined using the following Equation 1:

$$ECD = (\mathrm{MW}) + \frac{\Delta P}{0.052 * TVD} \qquad \text{Equation 1}$$

where MW is corrected for effect of wellbore temperature, pressure, and fluid compressibility, where ΔP is the total pressure drop in annulus 128 above the given point in the annulus, and where TVD is the vertical depth of the wellbore 104 above the given point in the annulus. The ΔP is evaluated using standard drilling fluids practices (e.g., API RP 13D, rheology and hydraulics of oil-well drilling fluids) or relevant software.

In some embodiments, the real-time, on-site PSD data obtained using the foregoing method 200 may be continuous over time where a monitoring and treatment loop is utilized, as indicated by the dashed arrows in FIG. 2. Additionally, it will be appreciated that the real-time, on-site PSD data obtained using the foregoing method 200 may further prove useful in determining the effect of PSD on rheology, sag, and formation damage. For instance, the PSD information may indicate whether the treatment fluid 102 is losing larger particles downhole, which may be an indication of loss to the formation (e.g., the formation 106 of FIG. 1). The real-time PSD information may also indicate whether there is sag in the wellbore 104 and the larger particles are accumulating at the bottom of the well or in a dip or elbow area of the wellbore 104. In such cases, the well operator may adjust drilling parameters or alter the mixture of the treatment fluid 102 so as to mitigate such issues.

Figure 3:
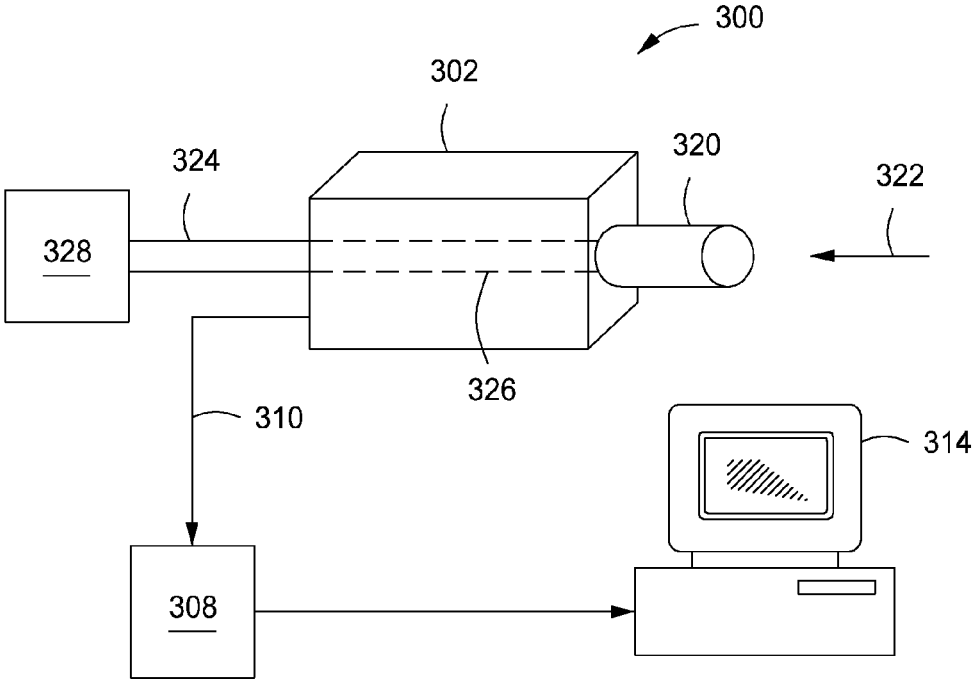
FIG. 3 is a schematic diagram showing an exemplary ultrasound device that may be used in accordance with embodiments of the present disclosure.

Referring now to FIG. 3, with continued reference to FIG. 1, illustrated is a schematic diagram of an exemplary ultrasound device 300 that may be used in accordance with embodiments of the present disclosure. The ultrasound device 300 may be the same as or similar to one or all of the ultrasound devices 140*a-c* of FIG. 1. Accordingly, the ultrasound device 300 may be a particle analysis system capable of characterizing particle concentration, size, and shape within a fluid, such as the treatment fluid 102 of FIG. 1.

In some embodiments, the ultrasound device 300 may comprise a flow system used for extracting and monitoring a fluid sample. The fluid sample may be extracted and delivered into a flow and interrogated to generate analytical information concerning the nature or properties of the fluid being monitored. In some cases, an ultrasound signal generator may emit ultrasound signals that interact with the fluid sample flowing within flow chamber and may result in sample-interacted ultrasound signals, which may be received by an ultrasound signal detector representing the signal information. Any form of such a system capable of performing the foregoing functions may be employed as the ultrasound device 300, provided it generates sufficient resolution to ensure the detection and quantification of particle sizes within the fluid sample. Such ultrasound devices 300 may employ ultrasound extinction, ultrasound backscattering, ultrasound phase velocity shift, and the like. Suitable forms of the ultrasound devices 300 may include, but are not limited to, the OPUS System, available from Sympatec GmbH in Lower Saxony, Germany.

One such ultrasound device 300, according to the embodiments described herein, employs ultrasound extinction techniques (also referred to as "ultrasonic extinction"). Ultrasound extinction allows a complete volume of a fluid sample to be analyzed to obtain information about particle suspension (e.g., PSD) therein, rather than restricting the measuring zone to a small layer in front of a glass window, as is the case with optical devices. Ultrasound extinction is dependent upon the acoustic properties of the particles within a fluid sample. At low particle concentrations (e.g., less than 5% volume per volume (v/v)), ultrasound extinction is described by the Bouguer-Lambert-Beer Law, according to Equation 1:

$$E = -\ln\left(\frac{l}{l_o}\right) = \alpha_{EXT,DS} * \Delta z, \quad \text{Equation 1}$$

where E is ultrasound extinction (unitless); l is radiation intensity transmitted in the presence of particles (units: power/area); $l_0$ is radiation intensity transmitted in the absence of particles (units: power/area); $\alpha_{EXT,DS}$ is the extinction coefficient of a fluid sample (units: reciprocal length); and Δz is the path length between an ultrasound signal generator and an ultrasound signal detector (units: length). The extinction coefficient ($\alpha_{EXT,DS}$) can be considered as product of particle extinction efficiency (K) with particle projectional area concentration. The particle extinction efficiency (K) would typically depend on particle size and ultrasound wavelength in the fluid medium. Further, K can also depend on the fluid viscosity and particle and fluid densities. The ultrasound extinction response is related to particle size and concentration, and is calculated from the ratio of the signal amplitudes on the generator and detector side. For higher particle concentrations, steric interactions may become prevalent, and may cause incoherent ultrasound waves to exceed coherent ultrasound waves forming part of the measured intensity. However, the steric interaction and dependent scattering may be accounted for such that the embodiments herein may measure particle concentrations up to about 35% v/v.

A commercial version of ultrasound device employing ultrasonic extinction using high frequency radiation is OPUS system, which allows measurements of particle size distribution from 0.01 μm to 3000 μm and solids concentration up to 70% by volume; the frequency of ultrasonic waves may be varied from 100 kilohertz (kHz) to 200 megahertz (MHz). Other available ultrasound devices employing ultrasound extinction for use in the embodiments described herein may include, but are not limited to, the ACOUSTOPHOR 8000, available from Pen Kem, Inc., with presented concentration measurements between 3.5% to 42% by volume and particle size distribution from 0.1 μm to 10 μm, and the ultrasound device developed by Ulrich Reibel and Friedrick Löffler in 1989, with presented broad range particle size distribution and ultrasonic wave frequencies from 0.5 MHz to 100 MHz.

Accordingly, the methods described herein may be used to determine PSD of treatment fluids having particle concentrations in the range of from a lower limit of about 1% v/v, 5% v/v, 10% v/v, 15% v/v, 20% v/v, 25% v/v, 30% v/v, and 35% v/v to an upper limit of about 75% v/v, 70% v/v, 65% v/v, 60% v/v, 55% v/v, 50% v/v, 45% v/v, 40% v/v, and 35% v/v, encompassing any value and subset therebetween.

In the illustrated embodiment, the ultrasound device 300 may include a body 302, wherein the ultrasound analysis of a fluid sample is performed, as will be discussed in detail with reference to an ultrasound extinction technique in FIG. 4. An inlet 320 may be in fluid communication with the body 302 for receiving a fluid sample 322 (e.g., a treatment fluid) to be observed in the body 302 of the ultrasound device 300. Although the inlet 320 is depicted on the side of body 302 and as having shape similar to a cylinder, it will be appreciate that the inlet 320 may have any size or shape (e.g., rectangular, circular, square, and the like) that is suitable for use in at a location in a fluid circuit, such as a location detailed in FIG. 1 above. Similarly, it may be located at any location in fluid communication with the body 302, without departing from the scope of the present disclosure.

Moreover, the means of receiving the fluid sample 322 into the inlet 320 (and then to the body 320) may take any form, without departing from the scope of the present disclosure. For example, the inlet 320 may be configured to protrude into a pipe, flow line, or other equipment in a fluid circuit (e.g., the feed pipe 126, the flow line 134, the solids control equipment 132, the retention pit 136, and the like). In such instances, the inlet 320 may be sealingly coupled to such pipe, flow line, or equipment and may receive a fluid sample 322 as it flows past the inlet 320. The inlet 320 may receive the fluid sample 322 through an opening on an end or along a side of the inlet 320, without departing from the scope of the present disclosure. Furthermore, more than one inlet 320 may be in fluid communication with the body 302, without departing from the scope of the present disclosure. As will be appreciated, the fluid sample 322 may be the treatment fluid 102 of FIG. 1, or an extracted sample thereof at any of the monitoring locations described above. Further, in some embodiments, a user, or the ultrasound device 300 itself, may dilute the fluid sample 322 so as to prepare it for analysis. In other cases, or in addition thereto, the fluid sample 322 may be pre-treated by running it through a shaker or centrifuge (e.g., the solids control unit 132 of FIG. 1) to remove particles of a certain size.

The body 302 and the inlet 320 may be fabricated of a material that is capable of use in a fluid circuit (FIG. 1) for determining PSD of a fluid sample either flowing or static in the body 302. Such suitable materials may include, but are not limited to, a metal (e.g., stainless steel), a high density carbon, a plastic (e.g., polycarbonate, polymethylmethacrylate (PMMA), polyvinylchloride (PVC), a glass (e.g., microscope glass, a glass extrusion, and the like), a semi-conductor material, a crystalline material, a polycrystalline material, quartz, a hot-pressed powder, a cold-pressed powder, sapphire, silicon, germanium, zinc selenide, zinc sulfide, a ceramic, and the like, and any combination thereof. It should be noted that the body 302 and the inlet 320 may or may not be made of the same material, without departing from the scope of the present disclosure.

Figure 4:
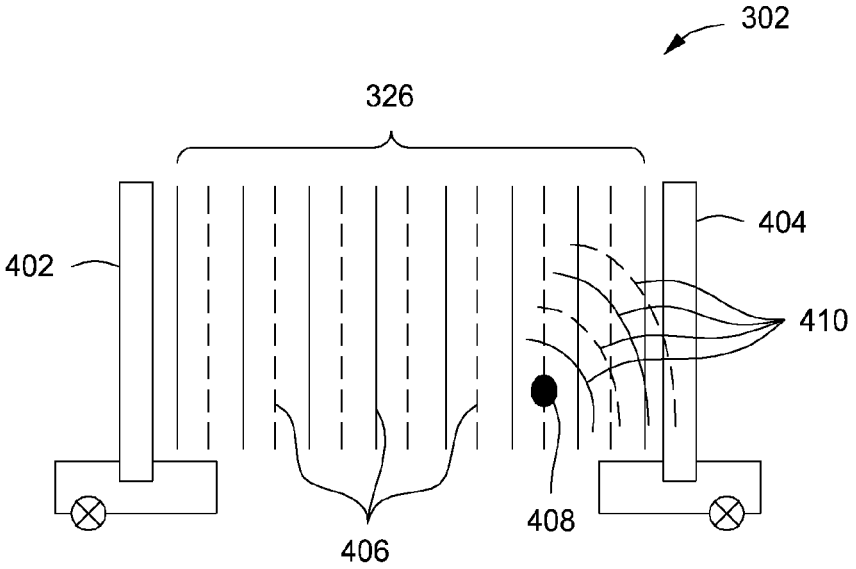
FIG. 4 is a schematic diagram showing an ultrasound technique that may be employed by an ultrasound device in accordance with the embodiments of the present disclosure.

As depicted, the body 302 may also include an outlet 324 through which the fluid sample 322 may pass after being analyzed using the ultrasound device 300 within the body 302 thereof (see FIG. 4). As depicted, the outlet 324 may be communicably coupled with the inlet 320 by a channel 326 through the body 302 through which the fluid sample 322 may flow (e.g., at a predetermined rate) or held static in the body 302 for analysis. The channel 326 may be of any shape, such as rectangular, cylindrical, and the like, without departing from the scope of the present disclosure. In some instances, the channel 326 may have a gap (between the ultrasound signal generator and detector) of a lower limit of about 0.1 millimeters (mm), 0.5 mm, 1 mm, 2 mm, 3 mm, 4 mm, 5 mm, 6 mm, 7 mm, 8 mm, 9 mm, and 10 mm to an upper limit of about 20 mm, 19 mm, 18 mm, 17 mm, 16 mm, 15 mm, 14 mm, 13 mm, 12 mm, 11 mm, and 10 mm, encompassing any value and subset therebetween, wherein the ultrasound device 300 may be used to analyze all or a subset of that volume (see FIG. 4).

As previously discussed, the inlet 320 may be communicably coupled to a fluid source, such as in the fluid circuit described in FIG. 1, and the outlet 324 may be communicably coupled to a pump 328 or another type of downstream means of drawing the fluid sample 322 through the inlet 320 and into the body 320 via the channel 326. Also as previously discussed, the fluid sample 322 may be flowing in the channel 326 by virtue of the pump 328 pressure and may be expelled downstream from the outlet 324. In other embodiments, the fluid sample 322 may be held static in the channel 326 such as by blocking the outlet 324 or otherwise removing the pump 328 pressure for the duration of analyzing the fluid sample 322. In other embodiments, a pump (not shown), such as a centrifugal pump, may alternatively be located at the inlet 320 and used to convey the fluid sample 322 through the flow chamber 302 and the channel 326.

Referring now to FIG. 4, with continued reference to FIG. 3, illustrated is the interior of the body 302 of the ultrasound device 300. As illustrated, the ultrasound technique utilized by the ultrasound device 300 is an ultrasound extinction technique. As shown, channel 326 is located between an ultrasound signal generator 402 and an ultrasound signal detector 404. The ultrasound signal generator 402 may be an electrical high frequency generator connected to a piezoelectric ultrasonic transducer, for example. The channel 326 represents the measuring zone of the fluid sample 322 (not shown) contained either flowingly or static in the channel 326. The ultrasound signal generator 402 transmits an ultrasound signal 406 through the fluid sample 322 in the channel 326 to interact with particles 408 therein (one shown). Although only one particle 408 is shown, it will be appreciated that greater than one particle may be analyzed using the methods described herein in concentrations previously discussed, without departing from the scope of the present disclosure.

Using ultrasound extinction, the particles 408 that are smaller than the wavelength of the ultrasound signal 406, are entrained and do not attenuate the signal, whereas particles that are larger than the wavelength of the ultrasound signal 406 scatter and attenuate the ultrasound signal 406. Accordingly, the wavelength of the ultrasound signal 406 produced by the ultrasound signal generator 402 may be tuned by adjusting frequency based on the size of the particles 408 in a particular treatment fluid 102. The particles 408 that attenuate and/or scatter the ultrasound signal 406 may produce sample-interacted ultrasound signals 410. The amount of attenuation and/or scatter of the ultrasound signal 406 depends on, among other things, those factors described with reference to Equation 1 above. Accordingly, all or a portion of the signal-interacted ultrasound signal 410 may be scattered away from the ultrasound signal detector 404. The ultrasound signal detector 404 receives the ultrasound signal 406 and any portion of the signal-interacted ultrasound signal 410 and the extinction of the original ultrasound signal 406 is calculated from the ration of the signal originally generated by the ultrasound signal generator 402 compared to the signal amplitudes received by the ultrasound signal generator 404. In some instances, the ultrasound signal detector 404 may convert the received ultrasound signals to an electrical signal, as discussed in greater detail below.

As previously discussed, Equation 1 may be used to describe ultrasonic extinction for low particle concentrations, while for higher particle concentrations additional interparticle interactions may also be considered. To obtain a PSD of the fluid sample 322, the attenuation spectrum at different ultrasound signal 406 frequencies is obtained and with knowledge of the acoustic properties represented by various extinction coefficients, PSD and particle concentration may be calculated from the signal detected by the ultrasound signal detector 404. In some embodiments, noise compensation (e.g. gas bubble correction, steric interaction correction), and the like may be implemented downstream of the ultrasound signal detector 404.

In some embodiments, the particles 408 for use in determining PSD described herein may range in size from a lower limit of about 0.01 micron (μm), 1 μm, 10 μm, 20 μm, 50 μm, 100 μm, 200 μm, 300 μm, 400 μm, 500 μm, 600 μm, 700 μm, 800 μm, 900 μm, 1000 μm, 1100 μm, 1200 μm, 1300 μm, 1400 μm, and 1500 μm to an upper limit of about 3000 μm, 2900 μm, 2800 μm, 2700 μm, 2600 μm, 2500 μm, 2400 μm, 2300 μm, 2200 μm, 2100 μm, 2000 μm, 1900 μm, 1800 μm, 1700 μm, 1600 μm, and 1500 μm, encompassing any value and subset therebetween. The ultrasound signal generator 402 may produce a frequency in the range of a lower limit of about 0.1 megahertz (MHz), 1 MHz, 5 MHz, 10 MHz, 20 MHz, 30 MHz, 40 MHz, 50 MHz, 60 MHz, 70 MHz, 80 MHz, 90 MHz, and 100 MHz to an upper limit of about 200 MHz, 190 MHz, 180 MHz, 170 MHz, 160 MHz, 150 MHz, 140 MHz, 130 MHz, 120 MHz, 110 MHz, and 100 MHz, encompassing any value and subset therebetween.

Referring again to FIG. 3, the ultrasound signal detector 404 (FIG. 4) may produce an output signal 310 that may be detected by a detection system 308, and conveyed to a computing device 314. The detection system 308, as depicted, is outside of the body 302 of the ultrasound device 300; however, it will be appreciated that the detection system may be housed within the body 302, without departing from the scope of the present disclosure. The detection system 308 may be configured to convert the output signal 310 into a computer-readable medium (e.g., an electrical signal). In some embodiments, the detection system 308 may include user-adjusted gain and threshold settings that determine the amount of extinction required for the ultrasound device 300 to acknowledge a passing particle. The detection system 308 may also be configured to receive the output signals 310 and produce information compatible with the specific needs of the user of the ultrasound device 300. Those of ordinary skill in the art will recognize that the specific detection system 308 described therein may be modified, such as through suitable programming, for example, to trigger desired signal activation and/or to manipulate received signals for desired output information. In other embodiments, the detection system 308 may be omitted from the ultrasound device 300, without departing from the scope of the present disclosure, wherein the signal from the ultrasound signal detector is directly conveyed to the computing device 314.

The computing device 314 may encompass any computing system suitable for receiving information, executing software programs, and producing output information including, but not limited to, images and data that may be observed by a user on a graphical user interface. The computing device 314 may be programmed to store the information received from the detection system 308 or the ultrasound signal detector 404 (FIG. 4) and to make calculations associated with the particles detected. For example, the computing device 314 may be programmed to provide specific information regarding the PSD and/or concentration of the fluid sample 322 (FIG. 1). In some embodiments, the computing device 314 may be the same as or similar to the signal processor 142 of FIG. 1. In other embodiments, however, the computing device 314 may be communicably coupled to the signal processor 142 such that any output signals (e.g., output signals 144*a-c* of FIG. 1) generated by the computing device 314 may be conveyed to the signal processor 142 for processing. The detection system 308 may also be coupled, directly or indirectly through the computing device 314. One or more computer programs may be stored in memory associated with the computing device 314 and, when executed by one or more processors of the computing device 314, may assist in the storing and analyzing of data captured by the ultrasound device 300.

It is to be understood that the computing device 314 (and/or the signal processor 142 of FIG. 1) used to gather the captured PSD and concentration information, perform calculations, and/or provide a graphical display related thereto may be associated with local or remote computing means, such as one or more central computers, in a local area network, a metropolitan area network, a wide area network, or through intranet and internet connections. The computing device 314 may include one or more discrete computer processor devices, and the computing device 314 may include computer devices operated by a centralized administrative entity or by a plurality of users located at one or more locations. Moreover, the computing device 314 may be programmed to execute one or more of the functions of the ultrasound device 300.

The foregoing operation of the ultrasound device 300 may be carried out as electronic functions performed through the computing device 314 based on computer programming steps. The functions configured to perform the steps described herein may be implemented in hardware and/or software. For example, particular software, firmware, or microcode functions executing on the computing device 314 can be used to operate the ultrasound device 300 and/or to output the signal therefrom and manipulate or display it, as desired. Alternatively, or in addition, hardware modules, such as programmable arrays, can be used in the devices to provide some or all of those functions, provided they are programmed to perform the steps described.

It is recognized that the various embodiments herein directed to computer control and artificial neural networks, including various blocks, modules, elements, components, methods, and algorithms, can be implemented using computer hardware, software, combinations thereof, and the like. To illustrate this interchangeability of hardware and software, various illustrative blocks, modules, elements, components, methods and algorithms have been described generally in terms of their functionality. Whether such functionality is implemented as hardware or software will depend upon the particular application and any imposed design constraints. For at least this reason, it is to be recognized that one of ordinary skill in the art can implement the described functionality in a variety of ways for a particular application. Further, various components and blocks can be arranged in a different order or partitioned differently, for example, without departing from the scope of the embodiments expressly described.

Computer hardware used to implement the various illustrative blocks, modules, elements, components, methods, and algorithms described herein can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable programmable read only memory (EPROM)), registers, hard disks, removable disks, CD-ROMS, DVDs, or any other like suitable storage device or medium.

Executable sequences described herein can be implemented with one or more sequences of code contained in a memory. In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM and flash EPROM.

It should also be noted that the various drawings provided herein are not necessarily drawn to scale nor are they, strictly speaking, depicted as mechanically precise as understood by those skilled in the art. Moreover, configurations or arrangements of components in the drawings are non-limiting. The drawings are merely illustrative in nature and used generally herein in order to supplement understanding of the systems and methods provided herein. The conceptual interpretations depicted therein accurately reflect the exemplary nature of the various embodiments disclosed.

Embodiments disclosed herein include:

Embodiment A

A well system, comprising: a drill string having an inlet and extending from a surface location into a wellbore and defining an annulus between the drill string and the wellbore; a fluid circuit that circulates a treatment fluid, the fluid circuit extending from the inlet, through the drill string to a bottom of the wellbore, back to the surface location within the annulus, and back to the inlet; and one or more ultrasound devices arranged at-line, off-line, or in-line with fluid circuit to monitor the treatment fluid and track a real-time particle size distribution (PSD) of one or more particles suspended within the treatment fluid.

Embodiment A may have one or more of the following additional elements in any combination:

Element A1: Wherein the treatment fluid is selected from the group consisting of drilling fluid, drill-in fluid, completion fluid, fracturing fluid, work-over fluid, a pill, a spacer, a sweep, and any combination thereof.

Element A2: Wherein the one or more particles are selected from the group consisting of weighting agents, lost circulation materials, wellbore cuttings, wellbore fines, neutral density particles, lightweight particles, particles added for stress cage applications, and any combination thereof.

Element A3: Wherein a first ultrasound device of the one or more ultrasound devices is in fluid communication with the fluid circuit and monitors the treatment fluid as the treatment fluid exits the wellbore.

Element A4: Wherein a first ultrasound device of the one or more ultrasound devices is in fluid communication with the fluid circuit and monitors the treatment fluid as the treatment fluid exits the wellbore, and wherein a second ultrasound device of the one or more ultrasound devices is in fluid communication with the fluid circuit and monitors the treatment fluid prior to being introduced into the wellbore.

Element A5: Wherein a first ultrasound device of the one or more ultrasound devices is in fluid communication with the fluid circuit and monitors the treatment fluid as the treatment fluid exits the wellbore, and wherein a second ultrasound device of the one or more ultrasound devices is in fluid communication with the fluid circuit and monitors the treatment fluid prior to being introduced into the wellbore; and wherein the first ultrasound device generates a first output signal and the second ultrasound device generates a second output signal, the well system further comprising: a signal processor communicably coupled to the first and second ultrasound devices to receive the first and second output signals and generate a resulting output signal, the resulting output signal being based on the first and second output signals and indicative of a difference in the PSD of the one or more particles.

Element A6: Further comprising: solids control equipment arranged in-line with the fluid circuit to receive the treatment fluid exiting the wellbore, wherein a first ultrasound device of the one or more ultrasound devices is arranged at-line, off-line, or in-line with the fluid circuit prior to the solids control equipment and a second ultrasound device of the one or more ultrasound devices is arranged at-line, off-line, or in-line with the fluid circuit following the solids control equipment; and a signal processor communicably coupled to the first and second ultrasound devices to receive first and second output signals generated by the first and second ultrasound devices, respectively, and generate a resulting output signal, the resulting output signal being based on the first and second output signals and indicative of a difference in the PSD of the one or more particles changed.

Element A7: Wherein the one or more ultrasound devices comprise: an inlet in fluid communication with a body defining a flow chamber for conveying the treatment fluid therethrough; and a computing device communicably coupled to the one or more ultrasound devices, wherein the one or more ultrasound devices tracks the PSD of the one or more particles suspended within the treatment fluid based on a sample of the treatment fluid in the flow chamber by an ultrasound technique selected from the group consisting of ultrasound extinction, ultrasound backscattering, ultrasound phase velocity shift, and any combination thereof.

Element A8: Wherein the one or more particles comprise wellbore cuttings or fines and the PSD of the wellbore cuttings or fines in the treatment fluid is indicative of cuttings disintegration in the treatment fluid.

Nonlimiting combinations applicable to A may include: A with A1 and A2; A with A1 and A3; A with A1 and A4; A with A1 and A5; A with A1 and A6; A with A1 and A7; A with A1 and A8; A with A2 and A3; A with A2 and A4; A with A2 and A5; A with A2 and A6; A with A2 and A7; A with A2 and A8; A with A3 and A4; A with A3 and A5; A with A3 and A6; A with A3 and A7; A with A3 and A8; A with A4 and A5; A with A4 and A6; A with A4 and A7; A with A4 and A8; A with A5 and A6; A with A5 and A7; A with A5 and A8; A with A6 and A7; A with A6 and A8; A with A7 and A8; A with A1, A3, and A7; A with A2, A4, and A6; A with A1, A2, A6, and A8; A with A2, A3, A4, and A7; A with A1, A2, A3, A4, and A5; A with A1, A2, A3, A4, A5, A6, A7, and A8.

Embodiment B

A method, comprising: circulating a treatment fluid through a fluid circuit of a well system including a drill string having an inlet and extending from a surface location into a wellbore, the fluid circuit extending from the inlet through the drill string to a bottom of the wellbore and back to the surface location within an annulus defined between the drill string and the wellbore, the fluid circuit further extending back to the inlet from the annulus; monitoring the treatment fluid with one or more ultrasound devices arranged at-line, off-line, or in-line with the fluid circuit; and determining a real-time particle size distribution (PSD) of one or more particles suspended within the treatment fluid with the one or more ultrasound devices.

Embodiment B may have one or more of the following additional elements in any combination:

Element B1: Wherein the one or more ultrasound devices determines the real-time PSD of one or more particles suspended within the treatment fluid by an ultrasound technique selected from the group consisting of ultrasound extinction, ultrasound backscattering, ultrasound phase velocity shift, and any combination thereof.

Element B2: Wherein determining the real-time PSD of the one or more particles comprises an operation selected from the group consisting of determining the real-time PSD of the one or more particles within the treatment fluid exiting the wellbore, determining the real-time PSD of the one or more particles within the treatment fluid entering the inlet of the drill string, and any combination thereof.

Element B3: Wherein the well system further comprises solids control equipment arranged in-line with the fluid circuit to receive the treatment fluid exiting the wellbore, and wherein determining the real-time PSD of the one or more particles comprises determining the real-time PSD of the one or more particles within the treatment fluid following the solids control equipment.

Element B4: Further comprising replenishing the treatment fluid with a material selected from the group consisting of lost circulation materials, weighting agents, and any combination thereof based on the real-time PSD of the one or more particles suspended within the treatment fluid.

Element B5: Wherein determining the real-time PSD of the one or more particles comprises determining a concentration of the one or more particles suspended within the treatment fluid.

Element B6: Wherein the one or more particles are wellbore cuttings or fines, the method further comprising reducing a concentration of the wellbore cuttings or fines in the treatment fluid based on the real-time PSD of the one or more particles.

Element B7: Wherein the one or more particles are wellbore cuttings or fines, the method further comprising reducing a concentration of the wellbore cuttings or fines in the treatment fluid based on the real-time PSD of the one or more particles, and wherein reducing a concentration of the wellbore cuttings or fines in the treatment fluid comprises an operation selected from the group consisting of diluting the treatment fluid with a base oil, adding a shale stabilizer to the treatment fluid, processing the treatment fluid within solids control equipment, and any combination thereof.

Nonlimiting combinations applicable to B may include: B with B1 and B2; B with B1 and B3; B with B1 and B4; B with B1 and B5; B with B1 and B6; B with B1 and B7; B with B2 and B3; B with B2 and B4; B with B2 and B5; B with B2 and B6; B with B2 and B7; B with B3 and B4; B with B3 and B5; B with B3 and B6; B with B3 and B7; B with B4 and B5; B with B4 and B6; B with B4 and B7; B with B5 and B6; B with B5 and B7; B with B6 and B7; B with B1, B3, and B7; B with B2, B4, and B6; B with B1, B2, B4, and B5; B with B2, B3, B4, and B7; B with B1, B2, B3, B4, and B5; B with B1, B2, B3, B4, B5, B6, and B7.

Embodiment C

A method, comprising: circulating a treatment fluid through a fluid circuit of a well system including a drill string having an inlet and extending from a surface location into a wellbore, the fluid circuit extending from the inlet through the drill string to a bottom of the wellbore and back to the surface location within an annulus defined between the drill string and the wellbore, the fluid circuit further extending back to the inlet from the annulus; monitoring the treatment fluid prior to introducing the treatment fluid into the inlet with a first ultrasound device arranged at-line, off-line, or in-line with the fluid circuit; generating a first output signal with the first ultrasound device, the first output signal being indicative of an initial particle size distribution (PSD) of one or more particles suspended within the treatment fluid; monitoring the treatment fluid exiting the wellbore with a second ultrasound device arranged at-line, off-line, or in-line with the fluid circuit; generating a second output signal with the second ultrasound device, the second output signal being indicative of a circulated PSD of the one or more particles; receiving the first and second output signals with a signal processor; and generating with the signal processor a resulting output signal indicative of a difference between the initial and circulated PSD.

Embodiment C may have one or more of the following additional elements in any combination:

Element C1: Wherein the first and second ultrasound devices employ an ultrasound technique selected from the group consisting of ultrasound extinction, ultrasound backscattering, ultrasound phase velocity shift, and any combination thereof.

Element C2: Wherein the one or more particles are at least one of lost circulation materials (LCM) and weighting agents, the method further comprising replenishing the treatment fluid with a material selected from the group consisting of LCM, weighting agents, and any combination thereof when the difference between the initial and circulated PSD indicates a loss of the at least one of LCM and weighting agents.

Element C3: Wherein the one or more particles are wellbore cuttings or fines, the method further comprising reducing a concentration of the wellbore cuttings or fines in the treatment fluid when the difference between the initial and circulated PSD indicates an accumulation of the wellbore cuttings or fines.

Element C4: Wherein the one or more particles are wellbore cuttings or fines, the method further comprising reducing a concentration of the wellbore cuttings or fines in the treatment fluid when the difference between the initial and circulated PSD indicates an accumulation of the wellbore cuttings or fines, and wherein reducing the concentration of the wellbore cuttings or fines in the treatment fluid comprises an operation selected from the group consisting of diluting the treatment fluid with a base oil, adding a shale stabilizer to the treatment fluid, processing the treatment fluid within solids control equipment, and any combination thereof.

Element C5: Further comprising evaluating an equivalent circulating density of the treatment fluid based on the first and second output signals.

Element C6: Wherein the one or more particles are wellbore cuttings or fines, the method further comprising determining whether there is sag in the wellbore based on the difference between the initial and circulated PSD.

Nonlimiting combinations applicable to C may include: C with C1 and C2; C with C1 and C3; C with C1 and C4; C with C1 and C5; C with C1 and C6; C with C2 and C3; C with C2 and C4; C with C2 and C5; C with C2 and C6; C with C3 and C4; C with C3 and C5; C with C3 and C6; C with C4 and C5; C with C4 and C6; C with C5 and C6; C with C1, C3, and C6; C with C2, C4, and C5; C with C1, C2, C4, and C5; C with C2, C3, C4, and C6; C with C1, C2, C3, C4, and C5; C with C1, C2, C3, C4, C5, and C6.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A well system, comprising:

a drill string having an inlet and extending from a surface location into a wellbore and defining an annulus between the drill string and the wellbore;

a fluid circuit that circulates a treatment fluid, the fluid circuit extending from the inlet, through the drill string to a bottom of the wellbore, back to the surface location within the annulus, and back to the inlet;

a first ultrasound device arranged at-line, off-line, or in-line with the fluid circuit, wherein the first ultrasound device is disposed at an inlet of solids control equipment to monitor the treatment fluid prior to flowing into the solids control equipment as it returns to the surface from the wellbore and track a real-time particle size distribution (PSD) of one or more particles suspended within the treatment fluid; and a second ultrasound device arranged at-line, off-line, or in-line with the fluid circuit, wherein the second ultrasound device is disposed at an outlet of solids control equipment to monitor the treatment fluid after it has undergone one or more treatments in the solids control equipment and track a real-time PSD of one or more particles suspended within the treatment fluid.

2. The well system of claim 1, wherein the first ultrasound is in fluid communication with the fluid circuit and monitors the treatment fluid as the treatment fluid exits the wellbore.

3. The well system of claim 2, wherein the second ultrasound device is in fluid communication with the fluid circuit and monitors the treatment fluid prior to being introduced into the wellbore.

4. The well system of claim 3, wherein the first ultrasound device generates a first output signal and the second ultrasound device generates a second output signal, the well system further comprising:

a signal processor communicably coupled to the first and second ultrasound devices to receive the first and second output signals and generate a resulting output signal, the resulting output signal being based on the first and second output signals and indicative of a difference in the PSD of the one or more particles.

5. The well system of claim 1, further comprising:

solids control equipment arranged in-line with the fluid circuit to receive the treatment fluid exiting the wellbore; and a signal processor communicably coupled to the first and second ultrasound devices to receive first and second output signals generated by the first and second ultrasound devices, respectively, and generate a resulting output signal, the resulting output signal being based on the first and second output signals and indicative of a difference in the PSD of the one or more particles changed.

6. The well system of claim 1, wherein the first ultrasound device and the second ultrasound device each comprise:

an inlet in fluid communication with a body defining a flow chamber for conveying the treatment fluid therethrough; and a computing device communicably coupled to the one or more ultrasound devices, wherein the one or more ultrasound devices tracks the PSD of the one or more particles suspended within the treatment fluid based on a sample of the treatment fluid in the flow chamber by an ultrasound technique selected from the group consisting of ultrasound extinction, ultrasound backscattering, ultrasound phase velocity shift, and any combination thereof.

7. The well system of claim 1, wherein the one or more particles comprise wellbore cuttings or fines and the PSD of the wellbore cuttings or fines in the treatment fluid is indicative of cuttings disintegration in the treatment fluid.

8. A method, comprising:

circulating a treatment fluid through a fluid circuit of a well system including a drill string having an inlet and extending from a surface location into a wellbore, the fluid circuit extending from the inlet through the drill string to a bottom of the wellbore and back to the surface location within an annulus defined between the drill string and the wellbore, the fluid circuit further extending back to the inlet from the annulus;

monitoring the treatment fluid prior to it flowing into a solids control equipment as it returns to the surface from the wellbore with a first ultrasound device arranged at-line, off-line, or in-line with the fluid circuit, wherein the first ultrasound device is disposed at an inlet of the solids control equipment;

monitoring the treatment fluid after it has undergone one or more treatments in the solids control equipment with a second ultrasound device arranged at-line, off-line, or in-line with the fluid circuit, wherein the second ultrasound device is disposed at an outlet of the solids control equipment; and determining a real-time particle size distribution (PSD) of one or more particles suspended within the treatment fluid with the one or more ultrasound devices.

9. The method of claim 8, wherein the first ultrasound device and the second ultrasound device determines the real-time PSD of one or more particles suspended within the treatment fluid by an ultrasound technique selected from the group consisting of ultrasound extinction, ultrasound backscattering, ultrasound phase velocity shift, and any combination thereof.

10. The method of claim 8, wherein determining the real-time PSD of the one or more particles comprises an operation selected from the group consisting of determining the real-time PSD of the one or more particles within the treatment fluid exiting the wellbore, determining the real-time PSD of the one or more particles within the treatment fluid entering the inlet of the drill string, and any combination thereof.

11. The method of claim 8, wherein the well system further comprises solids control equipment arranged in-line with the fluid circuit to receive the treatment fluid exiting the wellbore, and wherein determining the real-time PSD of the one or more particles comprises determining the real-time PSD of the one or more particles within the treatment fluid following the solids control equipment.

12. The method of claim 8, further comprising replenishing the treatment fluid with a material selected from the group consisting of lost circulation materials, weighting agents, and any combination thereof based on the real-time PSD of the one or more particles suspended within the treatment fluid.

13. The method of claim 8, wherein the one or more particles are wellbore cuttings or fines, the method further comprising reducing a concentration of the wellbore cuttings or fines in the treatment fluid based on the real-time PSD of the one or more particles.

14. The method of claim 13, wherein reducing the concentration of the wellbore cuttings or fines in the treatment fluid comprises an operation selected from the group consisting of diluting the treatment fluid with a base oil, adding a shale stabilizer to the treatment fluid, processing the treatment fluid within solids control equipment, and any combination thereof.

15. A method, comprising:

circulating a treatment fluid through a fluid circuit of a well system including a drill string having an inlet and extending from a surface location into a wellbore, the fluid circuit extending from the inlet through the drill string to a bottom of the wellbore and back to the surface location within an annulus defined between the drill string and the wellbore, the fluid circuit further extending back to the inlet from the annulus;

monitoring the treatment fluid prior to introducing the treatment fluid into the inlet with a first ultrasound device arranged at-line, off-line, or in-line with the fluid circuit, wherein the first ultrasound device is disposed at an inlet of solids control equipment to monitor the treatment fluid prior to flowing into the solids control equipment as it returns to the surface from the wellbore;

generating a first output signal with the first ultrasound device, the first output signal being indicative of an initial particle size distribution (PSD) of one or more particles suspended within the treatment fluid;

monitoring the treatment fluid exiting the wellbore with a second ultrasound device arranged at-line, off-line, or in-line with the fluid circuit, wherein the second ultrasound device is disposed at an outlet of solids control equipment to monitor the treatment fluid after it has undergone one or more treatments in the solids control equipment;

generating a second output signal with the second ultrasound device, the second output signal being indicative of a circulated PSD of the one or more particles;

receiving the first and second output signals with a signal processor;

generating with the signal processor a resulting output signal indicative of a difference between the initial and circulated PSD; and evaluating an equivalent circulating density of the treatment fluid based on the first and second output signals, wherein the equivalent circulating density is the effective fluid density experienced at a point in the annulus that comprises a contribution from the intrinsic density of the treatment fluid and a contribution from flow-induced pressure drop in the annulus above the point in the wellbore.

16. The method of claim 15, wherein the first and second ultrasound devices employ an ultrasound technique selected from the group consisting of ultrasound extinction, ultrasound backscattering, ultrasound phase velocity shift, and any combination thereof.

17. The method of claim 15, wherein the one or more particles are at least one of lost circulation materials (LCM) and weighting agents, the method further comprising replenishing the treatment fluid with a material selected from the group consisting of LCM, weighting agents, and any combination thereof when the difference between the initial and circulated PSD indicates a loss of the at least one of LCM and weighting agents.

18. The method of claim 15, wherein the one or more particles are wellbore cuttings or fines, the method further comprising reducing a concentration of the wellbore cuttings or fines in the treatment fluid when the difference between the initial and circulated PSD indicates an accumulation of the wellbore cuttings or fines.

19. The method of claim 15, wherein the one or more particles are wellborn cuttings or fines, the method further comprising determining whether there is sag in the wellbore based on the difference between the initial and circulated PSD.

20. The method of claim 17, further comprising determining whether there is a depletion of the lost circulation materials (LCM) and weighing agents in the treatment fluid based on the output signal.

21. The method of claim 20, further comprising determining whether there is an accumulation of wellbore cuttings or fines in the treatment fluid.

* * * * *